US006091316A

United States Patent [19]

Hofsäss

[11] Patent Number: 6,091,316

[45] Date of Patent: Jul. 18, 2000

[54] SWITCH HAVING A TEMPERATURE-DEPENDENT SWITCHING MECHANISM

[76] Inventor: Marcel Hofsäss, Höfener Strasse 29, 75305 Neuenbürg, Germany

[21] Appl. No.: 09/183,534

[22] Filed: Oct. 30, 1998

[30] Foreign Application Priority Data

Nov. 4, 1997 [DE] Germany ..... 197 48 589

[51] Int. Cl.[7] ..... H01H 37/04; H01H 37/54; H01H 37/14

[52] U.S. Cl. ..... 337/377; 337/342; 337/343; 337/362; 337/365

[58] Field of Search ..... 337/77, 100, 103, 337/104, 107, 141, 324, 377, 342, 333, 343, 362, 365, 373, 380

[56] References Cited

U.S. PATENT DOCUMENTS

| | | | |
|---|---|---|---|
| 4,306,210 | 12/1981 | Saur | 337/2 |
| 5,023,744 | 6/1991 | Hofsass | 361/26 |
| 5,367,279 | 11/1994 | Sakai | 337/104 |
| 5,615,072 | 3/1997 | Hofsaaa et al. | 361/24 |

FOREIGN PATENT DOCUMENTS

| | | |
|---|---|---|
| 4142716 | 6/1993 | Germany . |
| 196 04 939 | 8/1997 | Germany . |
| 196 09 310 | 9/1997 | Germany . |

*Primary Examiner*—Leo P. Picard
*Assistant Examiner*—Anatoly Vortman
*Attorney, Agent, or Firm*—Harness, Dickey & Pierce, P.L.C.

[57] ABSTRACT

A switch is described, having a housing 12 which receives a temperature-dependent switching mechanism 11 and which has a first housing part 15 on whose inner base 25 a first electrode 24 connected to a first external terminal 23 is arranged, as well as a second housing part 14, closing off the first housing part 15, that comprises a second electrode 20 connected to a second external terminal 22. The switching mechanism 11 creates, as a function of its temperature, an electrically conducting connection between the first and the second electrode 24, 20. A series resistor 34 is arranged in the housing 12, geometrically and electrically between the switching mechanism 11 and one of the two electrodes 20, 24.

8 Claims, 2 Drawing Sheets

SWITCH HAVING A TEMPERATURE-DEPENDENT SWITCHING MECHANISM

BACKGROUND OF THE INVENTION

1. Field of the Invention

The present invention relates to a switch having a housing which receives a temperature-dependent switching mechanism and which has a first housing part on whose inner base a first electrode connected to a first external terminal is arranged, as well as a second housing part, closing off the first housing part, that comprises a second electrode connected to a second external terminal, the switching mechanism creating, as a function of its temperature, an electrically conducting connection between the first and the second electrode.

2. Related Prior Art

A switch of this kind is known from DE 196 09 310 A1.

In the case of the known switch, the first housing part is produced from insulating material, into which the first electrode is embedded as an integral constituent by insert-molding or encapsulation. This first housing part is closed off by a second housing part in the form of a base made of electrically conductive material, the inner side of which acts as a second electrode.

The two electrodes are, so to speak, disk-shaped sheet-metal parts on which extensions which serve as external terminals of the switch are integrally configured. The base part rests on a shoulder of the first housing part, and is retained on the latter by a hot-stamped ring.

Arranged between the two electrodes, in the interior of the housing thus constituted, is an ordinary bimetallic switching mechanism whose spring disk is braced with its rim on the base part and which, below the switching temperature, presses the movable contact element carried by it against an inwardly projecting countercontact on the other electrode. Slipped over the movable contact element, in the usual way, is a bimetallic snap disk which is unstressed below its switching temperature and, when the temperature rises above its switching point, lifts the movable contact element away from the countercontact against the force of the spring disk and thus interrupts the electrical connection between the two external terminals.

The known switch described so far is extremely robust and has very small external dimensions, so that it can be used not only universally but also, in particular, in places where little installation space is available, i.e. for example in the coils of transformers or electric motors. Via the base part, this switch is very well thermally coupled to a device being monitored, so that any rise in the temperature of the device is transferred directly into the interior of the switch and there leads to a corresponding rise in the temperature of the bimetallic snap disk. Switches of this kind are connected in series between the device to be protected and a current source, so that the operating current of the device to be protected flows through the switch, which consequently shuts off that current in the event of an impermissible temperature rise.

It is often necessary, however, to monitor not only the temperature of the device to be protected but also the operating current in terms of maintaining a specific upper limit, in order to be able to shut off the device even before the temperature rise begins. The reason is that with electric motors in particular, it often happens that because of external influences the rotor comes to a stop or rotates only very slowly, which initially leads to a rise in the operating current, which in turn results in an elevation in the temperature of the device. If the elevated current flow already causes the device to shut off, the impermissible temperature rise is entirely avoided, which of course is advantageous.

This protective function of a switch having a temperature-dependent switching mechanism is called "current-dependent" switching, and is accomplished by the fact that a series resistor, through which the operating current of the device to be protected also flows, is connected in series with the switching mechanism. By way of the selection of the resistance of this series resistor and its thermal coupling to the switch, a specific current flow through the switch and thus through the series resistor leads to the generation of a specific quantity of heat which in turn heats the switch and thus the bimetallic snap disk in defined fashion. The resistance can thus be used to predefine an upper limit for the operating current. If the operating current exceeds that value, the heat generated in the series resistor heats the bimetallic snap disk above its switching temperature, so that the switch opens even before the device to be protected has heated up impermissibly.

A switch of this kind is known from DE 43 36 564 A1. This switch comprises first of all an encapsulated bimetallic switching mechanism which is housed in a two-part metal housing as known, for example, from DE 21 21 802 A1.

This encapsulated switch is then arranged on a ceramic support on which a thick-film resistor, which is connected via conductor paths to the conducting lower part of the encapsulated switching mechanism, is present. The other end of the resistor is connected to a solder dot onto which a first connector lead is soldered. The second connector lead is soldered onto the electrically conductive cover part of the encapsulated switching mechanism.

Although the known switch satisfactorily makes possible current-dependent switching and at the same time allows temperature monitoring, it still has a number of disadvantages.

For one, the ceramic support cannot sustain mechanical loads: during transport in bulk, hairline cracks occur which can be detected upon acceptance inspection only with a microscope. Soldering the leads onto the ceramic support often causes the conductor paths to detach. These problems require greater outlay in terms of inspection and checking, which correspondingly raises the price of the product. A further disadvantage is the low compressive stability of this design, which is not suitable for incorporation into windings of transformers or electric motors.

On the other hand, these known switches are extensively used because the attachment of a resistor having a defined resistance onto a ceramic support is a well-controlled method; here, for example, thick-film resistors are used.

SUMMARY OF THE INVENTION

In view of the above, it is an object of the present invention, to improve the switch mentioned at the outset such that it can be equipped, in a physically simple manner, with a series resistor for current-dependent switching.

In the case of the switch mentioned at the outset, this object is achieved according to the present invention in that a series resistor is arranged in the housing, geometrically and electrically between the switching mechanism and one of the two electrodes.

The object underlying the invention is completely achieved in this manner.

Specifically, the inventor of the present application has recognized that it is not necessary to arrange the series resistor beneath the housing of the switch on a separate support, but rather that it can be placed both electrically and geometrically between one of the electrodes and the switching mechanism. The series resistor is thus no longer accessible from the outside, i.e. it is protected from mechanical effects. A further advantage is the fact that the existing external terminals are retained, so that separate soldering actions for the external terminals, as in the existing art, are not necessary.

In a development, it is preferred if the switch comprises a ceramic support which is arranged, facing toward the switching mechanism, on one of the two electrodes, and carries the series resistor whose one end is connected to the electrode and other end to a countercontact for the switching mechanism.

This feature is advantageous in terms of design: the well-controlled ceramic technique, on which an easily adjusted series resistor is arranged, is used for the series resistor and its geometrical arrangement. But since in this case there is no longer any need to solder leads onto the ceramic support, and the latter is moreover mechanically protected by the housing, a very thin support can be used, so that the external dimensions of the known switch are changed only insignificantly or not at all.

It is further preferred if the first housing part is produced from insulating material in which the first electrode is held in lossproof fashion, the first electrode having a flat surface, facing toward the switching mechanism, on which the ceramic support is attached and to which the series resistor is electrically connected.

This feature is also advantageous in terms of design, since almost no changes are needed in the design or in the production sequence for the known switch in order to equip it with a series resistor for current-dependent switching. A flat surface onto which the ceramic support is laid is now used instead of the previous projecting countercontact. Because of the planar contact, the ceramic support experiences almost no mechanical load from the switching mechanism, so that the support, including the series resistor provided on it and the countercontact arranged on it, does not need to have any greater thickness than the countercontact in the switch according to the existing art. This means, however, that the switch can maintain its original dimensions; only the first electrode must have a different shape, since what is to be provided on it instead of the countercontact is a flat surface on which the ceramic support is attached. The ceramic support can, in this context, have a through contact for the series resistor, and can be adhesively mounted onto the flat surface in such a way that the through contact at the same time makes electrical contact with this electrode.

On the other hand, however, it is preferred if the ceramic support has at least one preferably laser-drilled through hole through which it is soldered onto the electrode and the series resistor is electrically connected to the latter.

This feature is advantageous in terms of design, specifically because only one operation is necessary in order to create both the mechanical and the electrical connection. The laser-drilled through holes are created using a well known process in which the ceramic support does not "jump," so that the high rejections rate which repeatedly occurs in the existing art in connection with ceramic supports and their subsequent processing is avoided. In addition, these ceramic supports can be delivered in magazined form rather than in bulk, in order to prevent further damage to the ceramic supports.

It is preferred in general if the first electrode is held in lossproof fashion in the first housing part, by encapsulation or insert-molding, during manufacture of the housing part, in such a way that it is an integral constituent of that housing part; the second housing part preferably being an electrically conducting base part whose inner base acts as the second electrode.

These features have already been realized per se in the switch mentioned at the outset; they make possible a highly compression-resistant, easily produced housing with small dimensions. All that is necessary now is to place the ceramic support into the housing part, made of insulating material, in to which the first electrode is embedded; the ceramic support is then adhesively bonded or soldered to the flat surface, thus simultaneously creating the electrical connection between the series resistor and the first electrode.

It is further preferred in this context if the switching mechanism comprises an electrically conducting spring disk which carries a movable contact element and works against a bimetallic snap disk that sits approximately centeredly on the movable contact element, the spring disk being braced at its rim against the one electrode and pressing the movable contact element against the other electrode when the switching mechanism is below its response temperature.

This feature is also known per se; it makes possible a self-aligning bimetallic switching mechanism in which the bimetallic snap disk is unstressed below its switching temperature, so that the switching temperature cannot shift as a result of mechanical stress. In conjunction with the ceramic support, this results in the further advantage of simple contacting to the series resistor. As already mentioned, the latter is connected at one end to the first electrode and at the other end to a countercontact onto which the spring disk presses the movable contact element, so that the series resistor is connected electrically in series between the first electrode and the spring disk, which in turn is connected to the second electrode, so that a series circuit made up of the series resistor and bimetallic switching mechanism is now arranged between the two external terminals of the switch.

Further features and advantages are evident from the description and the appended drawings.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

An embodiment of the invention is schown in the appended drawings and will be explained in more detail in the description below. In the drawings.

DETAILED DESCRIPTION OF A PREFERRED EMBODIMENT

Figure 1:
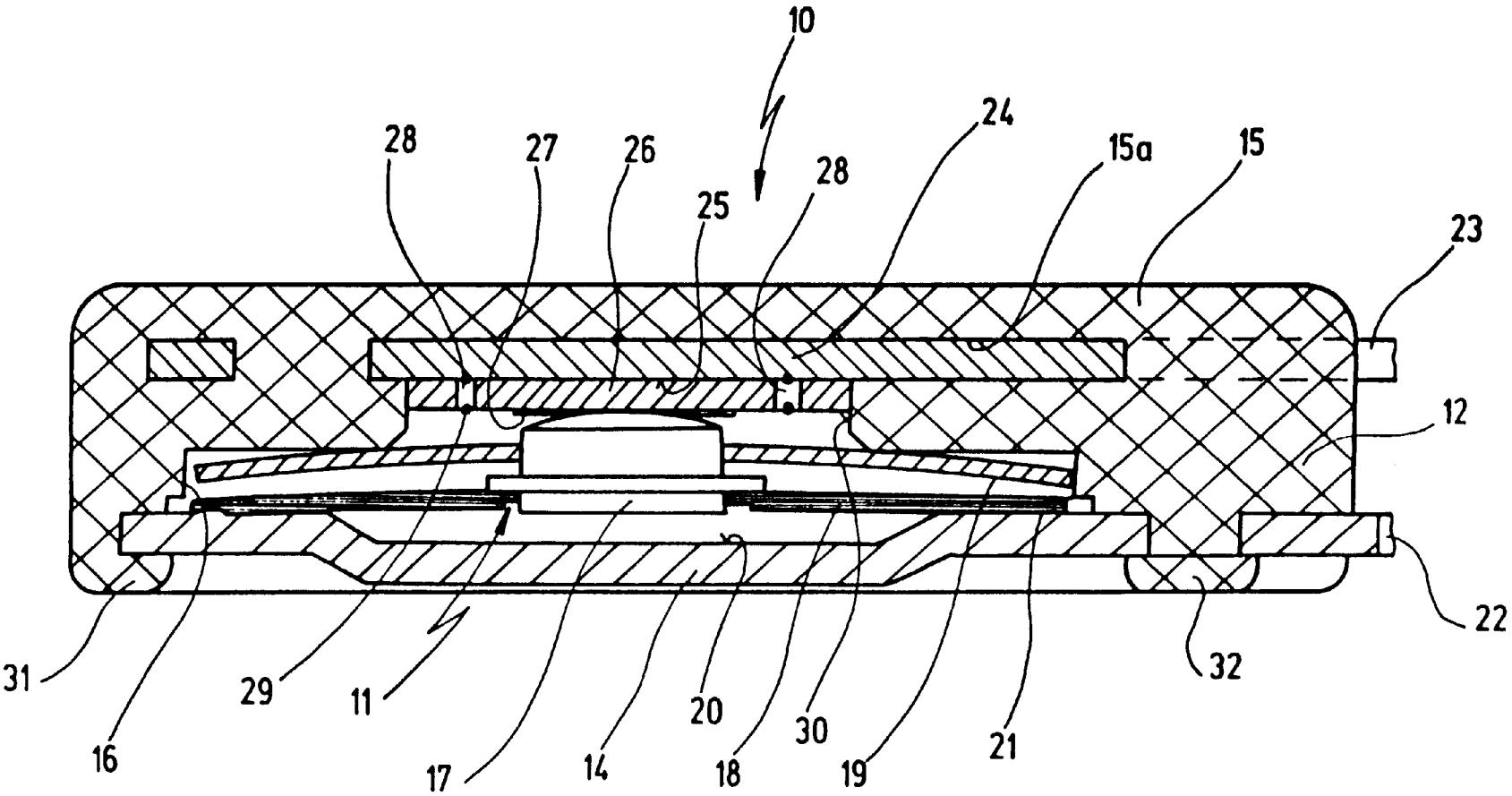
FIG. 1 shows the new switch in a schematic sectioned depiction, in a side view.

FIG. 1 shows, in a schematic side view, a new switch 10 which comprises a temperature-dependent switching mechanism 11 that is arranged in a housing 12.

Housing 12 has an electrically conducting base part 14 and a cup-like cover part 15, made of insulating material, which contains an annular space 16 into which temperature-dependent switching mechanism 11 is placed.

Switching mechanism 11 comprises a movable contact element 17 which is carried by a spring disk 18 and over which a bimetallic snap disk 19 is placed.

The electrically conducting base part 14 constitutes, with its inner side, an electrode 20 against which spring disk 18 braces with its rim 21. Base part 14 transitions integrally into a first external terminal 22 which is thereby connected in electrically conducting fashion to spring disk 18 and thus to movable contact element 17.

A second external terminal 23 of switch 10 is integrally connected to an insert-molded electrode 24 which is arranged on an inner base 15*a* of cover part 15. Cover part 15 is injection-molded around electrode 24, so that the latter is embedded in lossproof fashion into cover part 15. The arrangement is such that electrode 24 has a flat surface 25, facing toward switching mechanism 11, on which is arranged a ceramic disk 26 which carries a fixed countercontact 27 for movable contact element 17.

Ceramic disk 26 has laser-drilled passages 28 by way of which it is attached, with the aid of solder points 29, to electrode 24. In a manner yet to be described, a series resistor is arranged between solder points 29 and countercontact 27.

As a result of this arrangement, a series circuit made up of switching mechanism 11 and the series resistor is located between the two external terminals 22, 23. In the switching state shown in FIG. 1, bimetallic snap disk 19 is below its switching temperature, so that spring disk 18 presses movable contact 17 against fixed countercontact 27 so that an operating current of an electrical device to be protected, which flows through switching mechanism 10, also flows through and heats up the series resistor. As a function of the resistance of the series resistor and the magnitude of the current flowing, the ohmic heat generated in the series resistor heats up bimetallic snap disk 19, which in FIG. 1 is unstressed, so that it lifts movable contact element 17 away from fixed countercontact 27 against the force of spring disk 18, and thus interrupts the current.

It should also be mentioned that electrode 24 faces with its flat surface 25 into an annular space 30 into which ceramic disk 26 is placed after the insert-molding of electrode 24 into cover part 15, whereupon both a mechanical and an electrical connection to electrode 24 is created via solder points 29. Switching mechanism 11 is then placed into annular space 16, whereupon base part 14 is then set in place and is attached via a rim 31 and retaining pin 32 to cover part 15.

Figure 2:
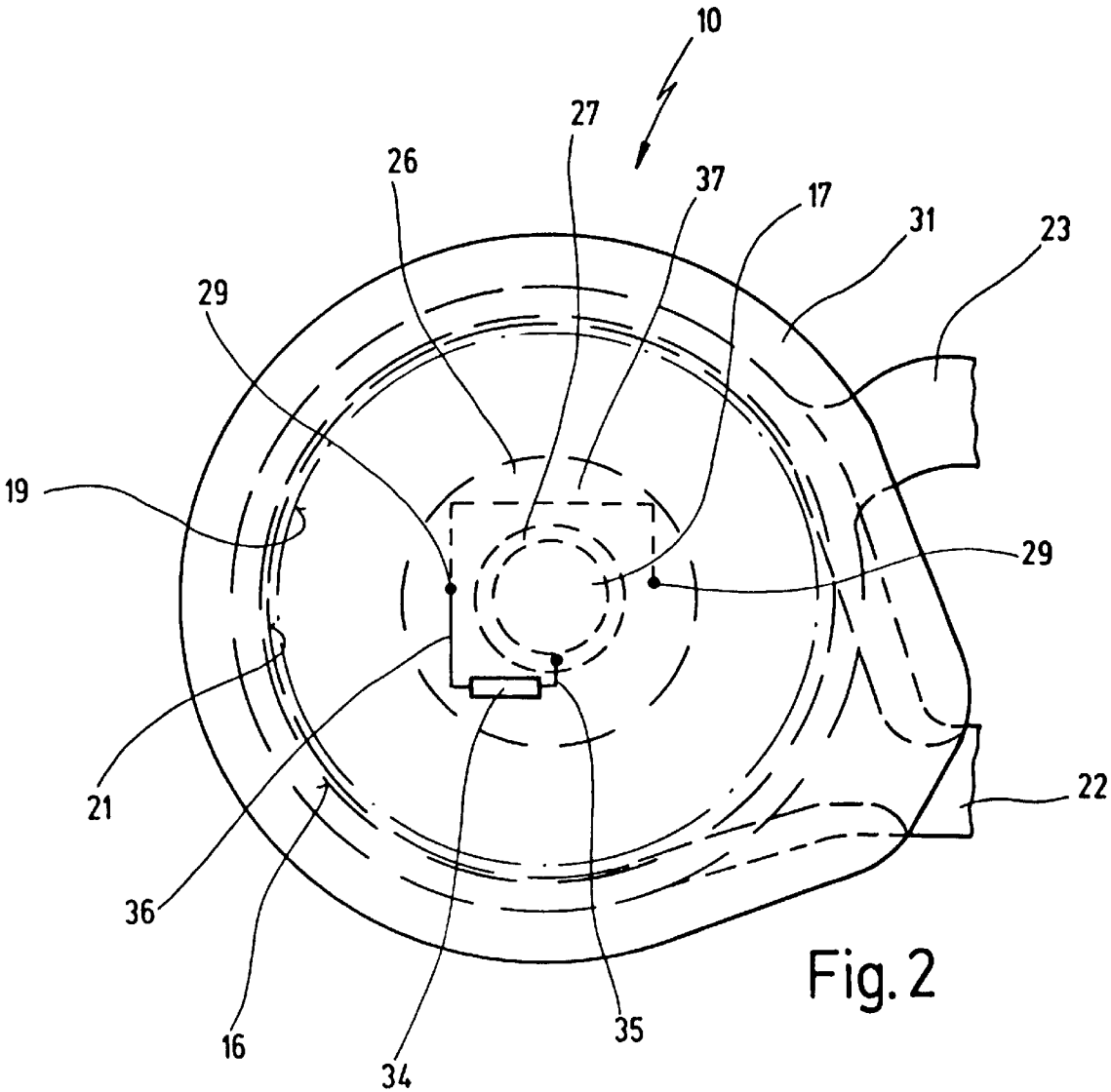
FIG. 2 shows a plan view of the switch of FIG. 1.

FIG. 2 shows a plan view of the switch from FIG. 1, and now also schematically indicates a series resistor 34, which is electrically connected via a conductor path 35 to fixed countercontact 27 and via conductor paths 36 and 37 to solder points 29. Series resistor 34 is an ordinary thick-film resistor which is arranged on ceramic disk 26 using known and well-controlled techniques; its resistance value can be adjusted as required with extreme precision, so that the operating current which causes switch 10 to switch can be accurately preselected.

Returning to FIG. 1, it should also be noted that series resistor 34 arranged on ceramic disk 26 is arranged both electrically and geometrically between electrode 24 and switching mechanism 11 in the interior of housing 12.

Therefore, what I claim is:

1. A switch, having a first and a second external terminal for connecting said switch to an electrical circuit;

a housing comprising a cover part and a base part, closing off said cover part, said cover part having an inner base, a first electrode being provided at said inner base and connected to said first external terminal, said base part comprising a second electrode connected to said second external terminal; and a temperature-dependent switching mechanism arranged within said housing for making, as a function of temperature, an electrically conducting connection between said first and second electrode, wherein a series resistor is arranged within said housing geometrically and electrically between said switching mechanism and one of said first and second electrode, said switch comprising a ceramic support arranged on one of said first and second electrode, facing toward the switching mechanism and carrying the series resistor, the series resistor having a first end connected to said one of said first and second electrode, and a second end connected to a counter contact cooperating with said switching mechanism.

2. The switch of claim 1, wherein said ceramic support has at least one through hole, said ceramic support being soldered through said through hole onto said one of said first and second electrode and said series resistor being electrically connected through said through hole to said one of said first and second electrode.

3. The switch of claim 2, wherein said through hole is a laser-drilled through hole.

4. The switch of claim 2, wherein the switching mechanism comprises an electrically conducting spring disk which carries a movable contact element and works against a bimetallic snap disk that sits approximately centeredly on the movable contact element, the spring disk being braced at its rim against one electrode and pressing the movable contact element against the other electrode when the switching mechanism is below its response temperature.

5. A switch, having a first and a second external terminal for connecting said switch to an electrical circuit;

a housing comprising a cover part and a base part, closing off said cover part, said cover part having an inner base, a first electrode being provided at said inner base and connected to said first external terminal, said base part comprising a second electrode connected to said second external terminal; and a temperature-dependent switching mechanism arranged within said housing for making, as a function of temperature, an electrically conducting connection between said first and second electrode, wherein a series resistor is arranged within said housing geometrically and electrically between said switching mechanism and one of said first and second electrode, wherein the cover part is produced from insulating material, said first electrode being held in lossproof fashion in said insulating material, the first electrode having a flat surface facing toward the switching mechanism, a ceramic support being attached to said flat surface and said series resistor being arranged at said ceramic support and electrically connected to said flat surface.

6. The switch of claim 5, wherein said ceramic support has at least one through hole, said ceramic support being soldered through said through hole onto said one of said first and second electrode and said series resistor being electrically connected through said through hole to said one of said first and second electrode.

7. A switch, having a first and a second external terminal for connecting said switch to an electrical circuit;

a housing comprising a cover part and a base part, closing off said cover part, said cover part having an inner base, a first electrode being provided at said inner base and connected to said first external terminal, said base part comprising a second electrode connected to said second external terminal; and a temperature-dependent switching mechanism arranged within said housing for making, as a function of temperature, an electrically conducting connection between said first and second electrode, wherein a series resistor is arranged within said housing geometrically and electrically between said switching mechanism and one of said first and second electrode, wherein the first electrode is held in lossproof fashion in the cover part, by encapsulation or insert-molding, during manufacture of the cover part, in such a way that it is an integral constituent of that cover part, and wherein the base part is an electrically conducting base part whose inner base is said second electrode.

8. A switch, having a first and a second external terminal for connecting said switch to an electrical circuit;

a housing comprising a cover part and a base part, closing off said cover part, said cover part having an inner base, a first electrode being provided at said inner base and connected to said first external terminal, said base part comprising a second electrode connected to said second external terminal; and a temperature-dependent switching mechanism arranged within said housing for making, as a function of temperature, an electrically conducting connection between said first and second electrode, wherein a series resistor is arranged within said housing geometrically and electrically between said switching mechanism and one of said first and second electrode, and the switching mechanism comprises an electrically conducting spring disk which carries a movable contact element and works against a bimetallic snap disk that sits approximately centeredly on the movable contact element, the spring disk being braced at its rim against one electrode and pressing the movable contact element against the other electrode when the switching mechanism is below its response temperature.

* * * * *